US012768568B2

(12) United States Patent
Lee et al.

(10) Patent No.: US 12,768,568 B2
(45) Date of Patent: Oct. 20, 2026

(54) CASE FOR WATER HEATER

(71) Applicant: KYUNGDONG NAVIEN CO., LTD., Gyeonggi-do (KR)

(72) Inventors: Kyu Hong Lee, Seoul (KR); Choong Gon Lee, Seoul (KR); Jun Kyu Park, Seoul (KR)

(73) Assignee: KYUNGDONG NAVIEN CO., LTD., Gyeonggi-do (KR)

( * ) Notice: Subject to any disclaimer, the term of this patent is extended or adjusted under 35 U.S.C. 154(b) by 419 days.

(21) Appl. No.: 18/390,518

(22) Filed: Dec. 20, 2023

(65) Prior Publication Data

US 2024/0210071 A1 Jun. 27, 2024

(30) Foreign Application Priority Data

Dec. 21, 2022 (KR) ..... 10-2022-0180938
Nov. 29, 2023 (KR) ..... 10-2023-0169098

(51) Int. Cl.
*F24H 9/02* (2006.01)

(52) U.S. Cl.
CPC ..... *F24H 9/02* (2013.01)

(58) Field of Classification Search
CPC ..... F24H 9/02
USPC ..... 126/114
See application file for complete search history.

(56) References Cited

U.S. PATENT DOCUMENTS 1,863,273 A * 6/1932 Hofferbert ..... F24H 9/02 219/546
1,978,213 A * 10/1934 Mackert ..... C23D 5/00 427/236
6,099,693 A * 8/2000 Palmer ..... C02F 1/18 203/1
7,407,165 B1 8/2008 Chisnell
2013/0161215 A1* 6/2013 Dowdy ..... F24F 1/58 206/320
2014/0209043 A1* 7/2014 Hardesty ..... F24H 15/225 220/694.1
2018/0363948 A1* 12/2018 Park ..... F24H 9/0031
(Continued)

FOREIGN PATENT DOCUMENTS

CN 203559668 U 4/2014
CN 204336103 U 5/2015
(Continued)

OTHER PUBLICATIONS

Russian Patent Office, Notification of First Office Action for corresponding application No. 2023134215, issued on Aug. 29, 2024, Russia, 8 pages.

*Primary Examiner* — Avinash A Savani
(74) *Attorney, Agent, or Firm* — McDonald Hopkins LLC

(57) ABSTRACT

A case for a water heater includes a case cover provided to accommodate the water heater in an inner space thereof, and a case frame configured to support the case cover in the inner space. The case cover includes a rear cover part including a plurality of holes passing through a plurality of pipes connected to the water heater, an upper cover part configured to cover an upper portion of the water heater and provided to be detached from the case frame, a side cover part configured to cover a side surface of the water heater and provided to be detached from the case frame, and a front cover part configured to cover a front surface of the water heater and provided to be detached from the side cover part.

17 Claims, 16 Drawing Sheets

(56) References Cited

U.S. PATENT DOCUMENTS

| | | | | |
|---|---|---|---|---|
| 2019/0203975 | A1 | 7/2019 | Kondo et al. | |
| 2020/0348047 | A1* | 11/2020 | Park | F24H 9/2035 |
| 2021/0071908 | A1* | 3/2021 | Park | F24H 9/0026 |

FOREIGN PATENT DOCUMENTS

| | | | |
|---|---|---|---|
| CN | 207230940 | U | 4/2018 |
| CN | 109240448 | A | 1/2019 |
| CN | 213320052 | U | 6/2021 |
| EP | 3462106 | A1 | 4/2019 |
| JP | 2002000357 | A | 1/2002 |
| JP | 2013002754 | A | 1/2013 |
| JP | 2020051434 | A | 4/2020 |
| JP | 2020106165 | A | 7/2020 |
| RU | 53860 | U1 | 6/2006 |

* cited by examiner

192a
- 192aa
- 192ab
- 192ac
- 192ad 192a-1 { 192aa-1, 192ab-1 }

CASE FOR WATER HEATER

CROSS-REFERENCE TO RELATED APPLICATIONS

This application claims the priority of Korean Patent Application No. 10-2022-0180938 filed on Dec. 21, 2022, and Korean Patent Application No. 10-2023-0169098 filed on Nov. 29, 2023, in the Korean Intellectual Property Office, the disclosures of which are incorporated herein by reference in their entireties.

BACKGROUND OF THE INVENTION

Field of the Invention

The present invention relates to a case for a water heater.

Description of the Related Art

A water heater is a device that heats water using combustion heat generated when burning a fuel and circulates the heated water through a heating pipe installed in an indoor space to heat rooms. In addition, the water heater is a device that supplies heated water to bathrooms, kitchens, etc. For example, the water heater may include various equipment such as boilers, etc.

Typically, the water heater may be assembled with various components and be disposed in an inner space of a case for the water heater having a predetermined width and size.

The water heater may be classified into personal water heaters used in homes and commercial water heaters used in commercial establishments.

In the case of the commercial water heaters, a plurality of water heaters may be disposed in a row. For example, the plurality of water heaters may be disposed in a cascade system.

Each of the plurality of water heaters disposed in the cascade system may be disposed adjacent to the lateral water heater. As an example, one water heater and the lateral water heater may be disposed with a gap of about 100 mm.

As the water heaters are disposed to be adjacent to each other, a work space for maintenance of the water heater may be narrowed. For example, as the water heaters are disposed to be adjacent to each other, work may be required with only the front cover removed. It is difficult to maintain and install the water heater due to the limited work space, and thus, the water heater may be deteriorated in quality.

SUMMARY OF THE INVENTION

An aspect of the present invention provides a case for a water heater, which is easily maintained and installed even in a limited work space.

According to an aspect of the present invention, there is provided a case for a water heater, including: a case cover provided to accommodate the water heater in an inner space thereof; and a case frame configured to support the case cover in the inner space, wherein the case cover includes: a rear cover part including a plurality of holes passing through a plurality of pipes connected to the water heater; an upper cover part configured to cover an upper portion of the water heater and provided to be detached from the case frame; a side cover part configured to cover a side surface of the water heater and provided to be detached from the case frame; and a front cover part configured to cover a front surface of the water heater and provided to be detached from the side cover part.

The front cover part may include a hook member, the side cover part may include a locking member coupled to the hook member, and the locking member may be hooked on the hook member so that the front cover part is mounted on the side cover part.

The side cover part may be mounted on the case frame by an outer fixing member that passes through a portion of the side cover part and a portion of the case frame from the outside.

The upper cover part may be mounted on the case frame by an inner fixing member that passes through a portion of the upper cover part and a portion of the case frame from the inside.

The case frame may further include a support member, wherein, as one end of the support member is fixed to a portion of the case frame, and the other end of the support member is fixed to a portion of the upper cover part, the support member may be configured to support the upper cover part so as to be maintained in an opened state with respect to the case frame.

A portion of the side cover part may be hinge-coupled to a portion of the rear cover part.

The side cover part may further include a hinge shaft that protrudes downward, the rear cover part may include a shaft accommodation member configured to accommodate the hinge shaft, a shaft of the hinge shaft member may protrude downward, and as the shaft is inserted into an accommodation part of the shaft accommodation member, the side cover part may be hinge-coupled to the rear cover part.

The side cover part may be mounted on the case frame so as to be separable upward from the case frame.

The case cover may further include a side fixing cover part disposed below the side cover part and fixed to the case frame, and a protruding area protruding upward may be defined on a top surface of the side fixing cover part.

The protruding area may include: a first protruding area having a predetermined thickness and extending in a direction of a side surface perpendicular to an upward direction; and a second protruding area inclined downward with respect to a direction that is away from the first protruding area and having a thickness that is gradually changed.

The case may further include a packing member coupled to the case frame and in contact with the case frame and the case cover to maintain sealing of the inner space.

The packing member may include: a front packing member disposed between the front cover part and the case frame to extend along a circumference of the front cover part; and a side packing member disposed between the side cover part and the case frame to extend along a circumference of the side cover part.

An upper end of each of the front packing member and the side packing member may be disposed between the upper cover part and the side cover part or between the upper cover part and the front cover part to extend along a circumference of the upper cover part.

The case may further include: a display mounted on the front cover part; and a display packing member extending along a circumference of the display to seal a gap between the display and the front cover part.

The case may further include a hole packing member provided in each of the plurality of holes to seal a gap between the pipe and the rear cover part.

The hole packing member may include: a pipe sealing part attached to the pipe; a rear sealing part attached to the rear cover part; and a flexible sealing part provided between the pipe sealing part and the rear sealing part.

The hole packing member may be mounted on the rear cover part through hole, and be configured to define a compression space provided therein along a circumference of the pipe, extending in a meandered shape along a circumference of the compression space.

The upper cover part may be provided to be hinge-coupled to the rear cover part, and the upper cover part may be provided to be rotatable with respect to the rear cover part around the hinge member.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

Figure 1:
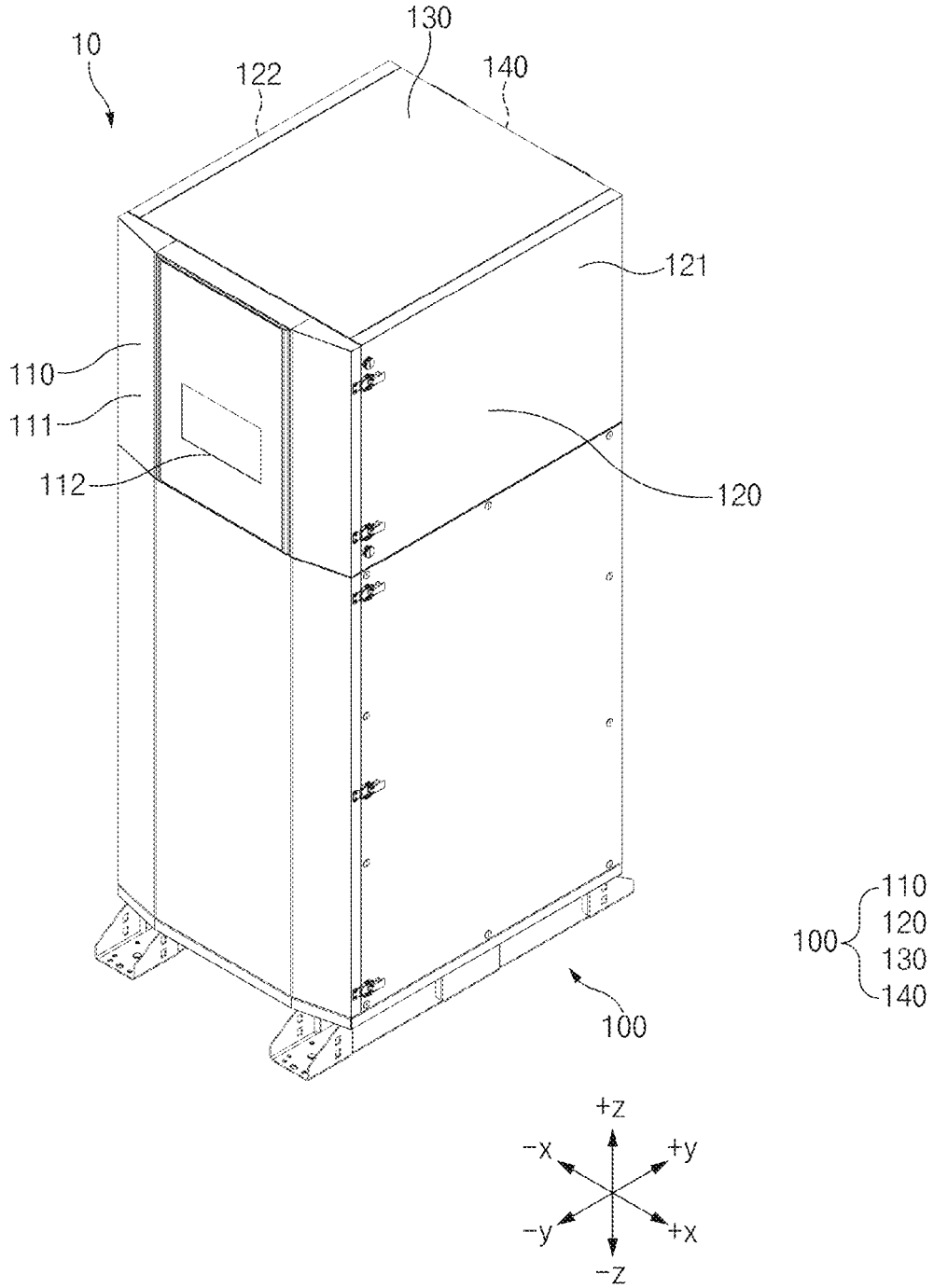
FIG. 1 is a perspective view of a case for a water heater.

Hereinafter, embodiments of the present invention will be described in detail with reference to the accompanying drawings. In adding of reference numerals to components of each drawing, it should be noted that the same components have the same numerals as much as possible even if the components are displayed on different drawings. In the following description of the present invention, a detailed description of known functions and configurations incorporated herein will be omitted to avoid making the subject matter of the present invention unclear.

In this specification, front, rear, left and right, and up and down directions may be referred to for convenience of explanation and may be directions perpendicular to each other. However, these directions may be determined relative to a direction in which a case for a water heater is disposed, and the up and down direction may not necessarily mean a vertical direction.

In addition, the term pipe used below may mean a tube-shaped pipe, through which a fluid flows, and may refer to components that have various materials and shapes, such as a soft tube and a metal pipe.

FIG. 1 is a perspective view of a case for a water heater.

Figure 2:
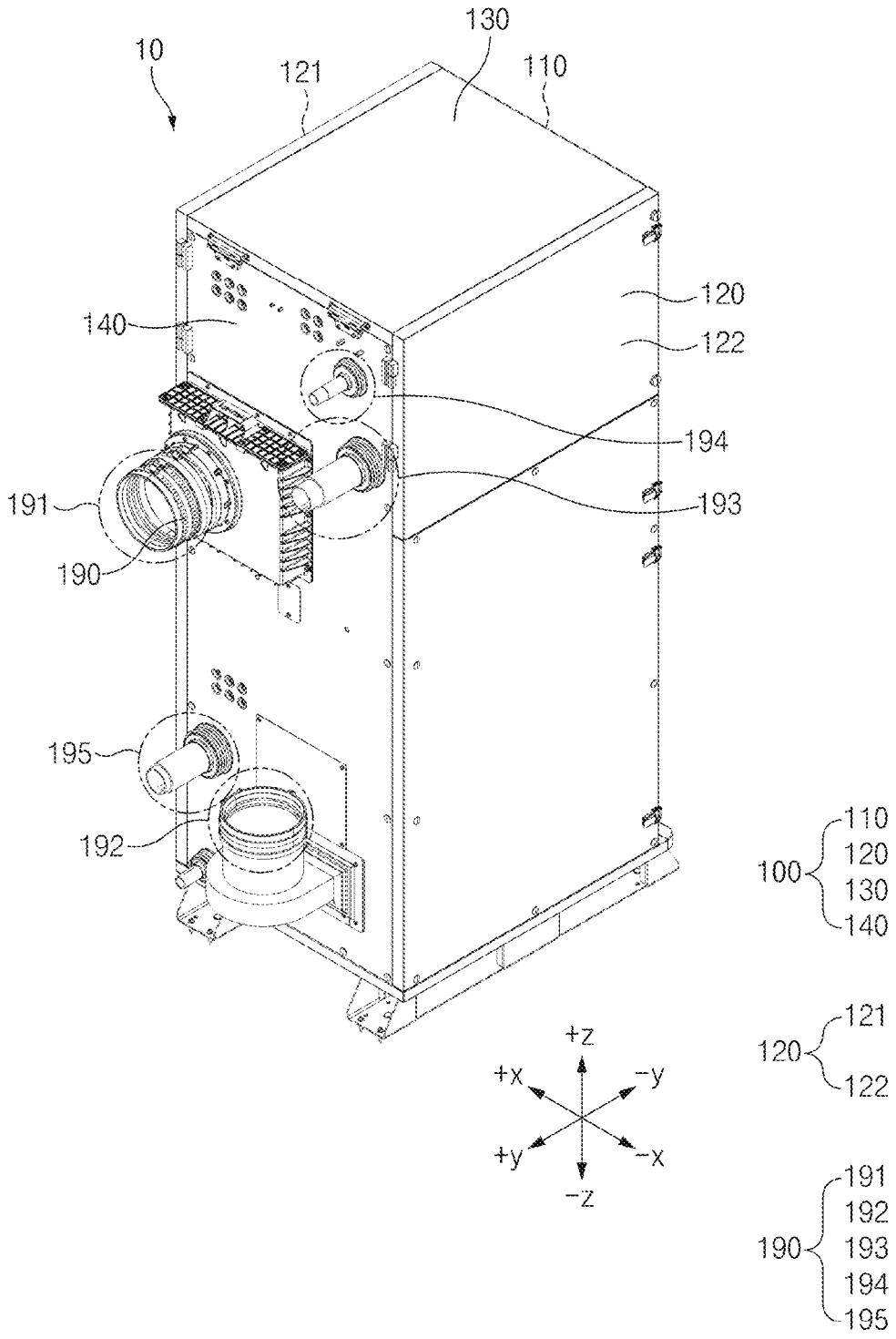
FIG. 2 is a perspective view of the case for the water heater when viewed in a direction different from that in FIG. 1.

FIG. 2 is a perspective view of the case for the water heater when viewed in a direction different from that in FIG. 1.

Figure 3:
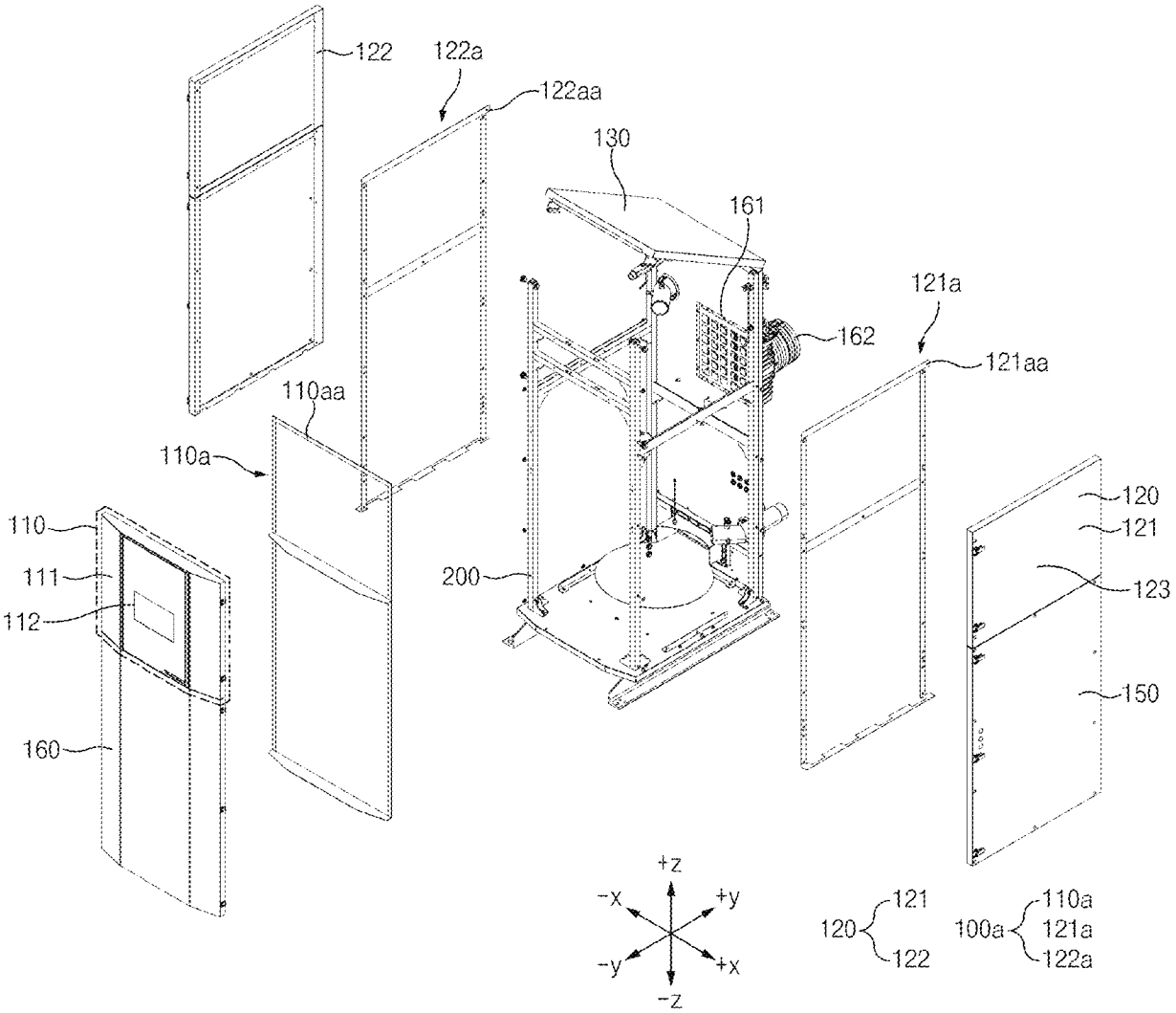
FIG. 3 is an exploded view of the case for the water heater.

FIG. 3 is an exploded view of the case for the water heater.

A case 10 for a water heater (hereinafter, referred to as a water heater case 10) may include a case that accommodates a water heater 20. For example, the water heater 20 may be accommodated in an inner space of the water heater case 10.

The water heater case 10 may include a sealing case that seals a gas flowing into the water heater 20. For example, the water heater case 10 may include a plurality of holes 190. The water heater case 10 may be sealed to prevent a gas flowing inward through the plurality of holes 190 from leaking to the outside.

According to an embodiment of the present invention, the water heater case 10 may include a case cover 100 and a case frame 200.

The case cover 100 may accommodate the water heater 20. For example, the water heater 20 may be accommodated in the inner space of the case cover 100. For example, the case cover 100 may be provided to surround the water heater 20.

The case frame 200 may support the case cover 100. The case frame 200 may support the case cover 100 in an inner space defined around the case cover 100. For example, the case cover 100 may include an outer surface exposed to the outside and an inner surface facing the inside. The case frame 200 may be disposed on an inner surface of the case cover 100 in the inner space of the water heater case 10 to support the case cover 100.

As a capacity of each of the water heater case 10 and the water heater 20 increases, a supply amount of gas flowing from the outside may increase. In this case, when sealing force of the water heater case 10 is reduced, an external gas may not be properly supplied to the water heater 20, and the quality of the water heater 20 may be deteriorated. In addition, when foreign substances including dust are supplied through various gaps in the water heater case 10, the water heater 20 may be damaged. To prevent this limitation, the sealing force of the water heater case 10 needs to be maintained.

To maintain the sealing of the inner space of the case cover 100, the case frame 200 may include a packing member **100*a*. For example, the packing member 100*a* may be attached to the case frame 200. For example, the packing member 100*a* may be disposed on an area on which the case frame 200 and the case cover 100** are in contact with each other.

The water heater case 10 surrounded by the case cover 100 may be sealed to prevent the gas flowing into the water heater case 10 from leaking by the packing member **100*a* disposed on the case frame 200. For example, the packing member 100*a* may be coupled to the case frame 200 and in contact the case frame 200 and the case cover 100 to maintain the sealing of the inner space of the water heater case 10**.

For example, as the packing member 100*a* is disposed on the case frame 200, an empty space between the case cover 100 and the case frame 200 may be filled. As the empty space is filled, the gas flowing into the water heater case 10 may be prevented from being discharged to the outside.

An amount of gas discharged to the outside of the water heater case 10 may be reduced by improving the sealing force of the water heater case 10 through the packing member 100*a*. As the amount of gas discharged to the outside is reduced, the quality of the water heater may be improved. As the amount of gas discharged to the outside is reduced, a lifespan of the water heater may increase.

In more detail, the packing member 100*a* may be disposed between the case frame 200 and the case cover 100. The packing member 100*a* may include a front packing member 110*a*, a first side packing member 121*a*, and a second side packing member 122*a*.

The case cover 100 may include a front cover part 110, a side cover part 120, an upper cover part 130, and a rear cover part 140.

The front cover part 110 may be disposed on a front surface of the water heater case 10. For example, the front cover part 110 may include a front plate of the water heater case 10, which is directed in a first direction (e.g., −y direction).

The front cover part 110 may cover the front surface of the water heater 20. For example, the front cover part 110 may be disposed on the front surface of the water heater 20.

A display 112 may be disposed on a portion of the front cover 110. For example, the display 112 may be disposed at a central portion of the front cover 110, but the location of the display 112 is not limited thereto.

A front fixing cover part 160 may be provided below the front cover part 110. A front packing member 110*a* may be provided between the front cover part 110, the front fixing cover part 160 and the case frame 200.

The front packing member 110*a* may be disposed between each of the front cover part 110 and the front fixing cover part 160 and the case frame 200. The front packing member 110*a* may extend along a circumference of the front cover part 110 and a circumference of the front fixing cover part 160 to seal gaps between the front cover part 110, the front fixing cover part 160, and the case frame 200.

The reason why the front packing member 110*a* is disposed as described above may be because it is a portion that requires sealing of the water heater case 10 along the circumference of each of the front cover part 110 and the front fixing cover part 160. Due to this structure, the front packing member 110*a* may extend along the circumference of each of the front cover part 110 and the front fixing cover part 160 to improve the sealing of the water heater case 10.

The side cover part 120 may be disposed on the side surface of the water heater case 10. For example, the side cover part 120 may include a side plate of the water heater case 10, which is directed in a lateral direction (e.g., +x direction or −x direction).

The side cover part 120 may include a first side cover part 121 and a second side cover part 122. For example, the first side cover part 121 may be one surface of the water heater case 10, which is directed in a second direction (e.g., +x direction). The second side cover part 122 may be one surface of the water heater case 10, which is directed in a third direction (e.g., −x direction) that is opposite to the second direction.

The side cover part 120 may cover the side surface of the water heater 20. For example, the side cover part 120 may be disposed on the side surface of the water heater 20. For example, when the water heater case 10 is viewed from a front side, the first side cover part 121 may be disposed at a right side of the water heater 20, and the second side cover part 122 may be disposed at a left side of the water heater 20.

A side fixing cover part 150 may be provided below the first side cover part 121 or the second side cover part 122. A first side packing member 121*a* may be provided between the first side cover part 121, the side fixing cover part 150, and the case frame 200. A second side packing member 122*a* may be provided between the second side cover part 122, the side fixing cover part 150, and the case frame 200.

The first side packing member 121*a* may be disposed between the first side cover part 121, the side fixing cover part 150 that fixes the first side cover part 121, and the case frame 200. The first side packing member 121*a* may extend along a circumference of the first side cover part 121 and a circumference of the side fixing cover part 150 disposed below the first side cover part 121.

In addition, the second side packing member 122*a* may be disposed between the second side cover part 122, the side fixing cover part 150 that fixes the second side cover part 122, and the case frame 200. The second side packing member 122*a* may extend along a circumference of the second side cover part 122 and a circumference of the side fixing cover part 150 disposed below the second side cover part 122.

The reason why the first and second side packing members 121*a* and 122*a* are disposed as described above, it is because the sealing of the water heater case 10 is necessary along the circumferences of the first and second side cover parts 121 and 122 and the side fixing cover part 150. Due to this structure, the first and second side packing members 121*a* and 122*a* may extend along the circumferences of the side cover part 120 and the side fixing cover part 160 to improve the sealing of the water heater case 10.

The upper cover part 130 may be disposed at an upper portion of the water heater case 10. For example, the upper cover part 130 may include an upper plate of the water heater case 10, which is directed in a fourth direction (e.g., +z direction).

The upper cover part 130 may cover the top surface of the water heater 20. For example, the upper cover part 130 may be disposed on the water heater 20.

Here, the sealing may be required between the upper cover part 130 and the front cover part 110 or between the upper cover part 130 and each of the first and second side cover parts 121 and 122. For this, an upper end 110*aa* of the front packing member 110*a* may extend along a circumference of the upper cover part 130 so as to be disposed between the upper cover 130 and the front cover 110, thereby providing the sealing between the upper cover 130 and the front cover 110.

Upper ends 121*aa* and 122*aa* of the first and second side packing members 121*a* and 122*a* may be disposed between the upper cover part 130 and the first and second side cover parts 121 and 122 and may extend along the circumference of the upper cover part 130 to seal the gaps between the upper cover part 130 and the first and second side cover parts 121 and 122.

Each of the upper ends 110*aa*, 121*aa*, and 122*aa* of the front packing member 110*a* and the first and second side packing members 121*a* and 122*a* may extend along the circumference of the upper cover part 130 to improve the sealing between the upper cover part 130 and the case frame 200.

The water heater case 10 may be sealed so that the gas flowing therein is not discharged to the outside by the packing member 110*a* by the packing member 110*a* disposed on an area that is in contact with each of the front cover part 110, the side cover part 120, and the top cover part 130.

Due to this structure, the empty space between the components of the case cover 100 may be filled. As the empty space is filled, the gas flowing into the water heater case 10 may be prevented from being discharged to the outside.

An amount of gas discharged to the outside of the water heater case 10 may be reduced by improving the sealing force of the water heater case 10 through the packing member 100*a*. As the amount of gas discharged to the outside is reduced, the quality of the water heater may be improved. As the amount of gas discharged to the outside is reduced, a lifespan of the water heater may increase.

The rear cover part 140 may be disposed on a rear surface of the water heater case 10. For example, the upper cover part 130 may include a rear plate of the water heater case 10, which is directed in a fifth direction (e.g., −y direction). The rear cover part 140 may cover a rear surface of the water heater 20. For example, the rear cover part 140 may be disposed at a rear side of the water heater 20.

The rear cover part 140 may include a plurality of holes 190. For example, the plurality of holes 190 may be connected to the water heater 20 accommodated in the inner space of the water heater case 10. For example, the plurality of holes 190 may be connected to a plurality of pipes connected to the water heater 20. For example, the plurality of pipes may pass through the plurality of holes 190.

The plurality of holes 190 may include a first hole 191, a second hole 192, a third hole 193, a fourth hole 194, and a fifth hole 195.

Referring to FIG. 3, the first hole 191 may include a filter 161 that filters a gas flowing into the inner space of the water heater case 10 from the outside and a first pipe 162 through which an external gas flows. The gas flowing through the first pipe 162 may flow into the water heater case 10 through the filter 161.

The sealing of the water heater case 10 may be maintained through the packing member 100*a* to block foreign substances through the filter 161 so that the water heater 20 is used for a long period of time. In addition, the quality of the water heater may be improved.

The second hole 192 may be connected to a pipe through which the gas discharged from the water heater 20 passes. The gas may be discharged from the water heater 20 to the outside through the second hole 192.

The third hole 193 may be connected to the second pipe 163 (see FIG. 5) through which the water discharged from the water heater 20 passes. The water may be discharged from the water heater 20 to the outside through the third hole 193.

In addition to the first hole 191, the second hole 192, and the third hole 193, the plurality of holes 190 may further include a fourth hole 194 and a fifth hole 195, through which a gas or other fluid is discharged.

Figure 4:
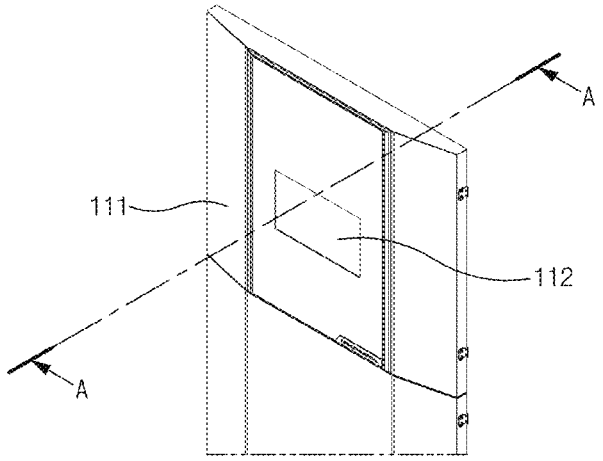
FIG. 4 is an enlarged vertical cross-sectional view taken along line A-A of a front cover part.
Figure 4:
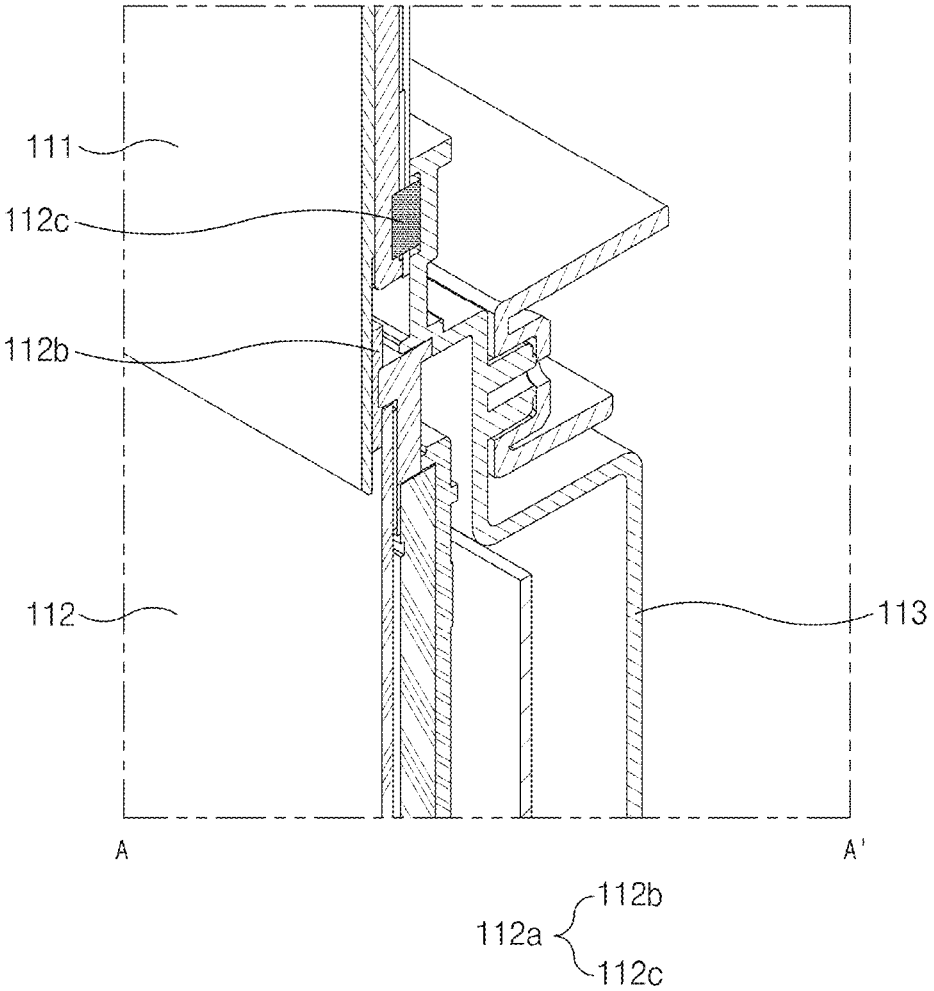

FIG. 4 is an enlarged vertical cross-sectional view taken along line A-A of the front cover part.

Figure 5:
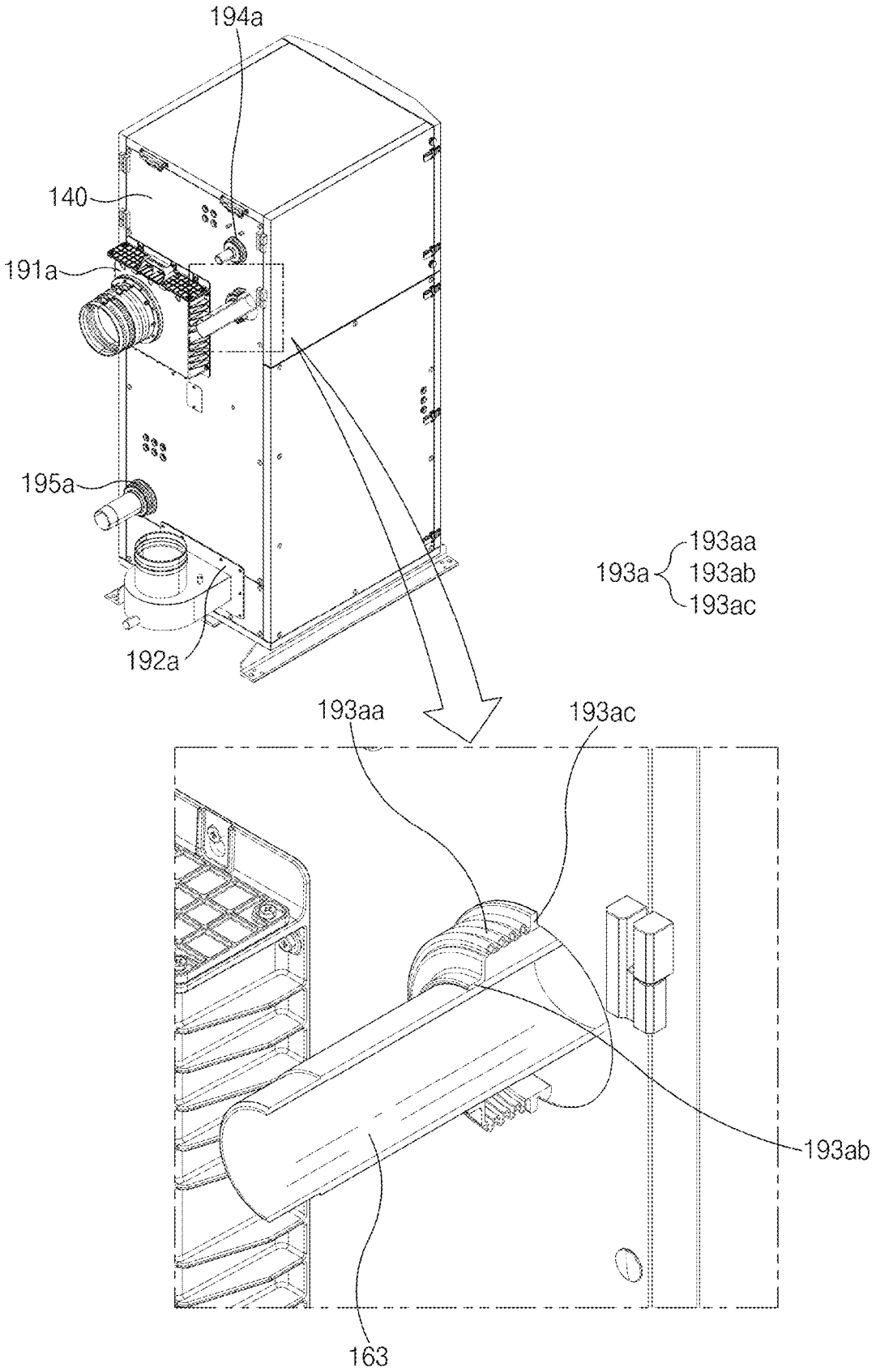
FIG. 5 is an enlarged vertical cross-sectional view along a third hole of a rear cover part.

FIG. 5 is an enlarged vertical cross-sectional view along the third hole of the rear cover part.

Figure 6:
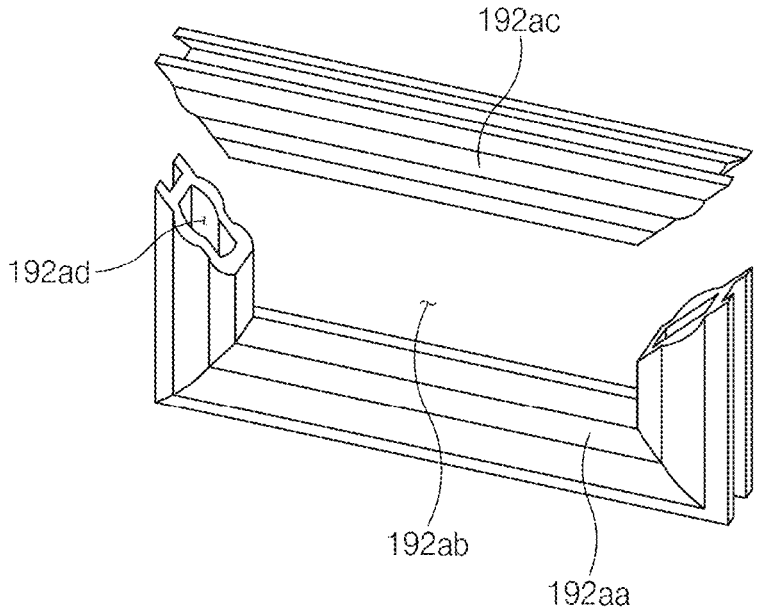
FIG. 6 is a perspective view of a second hole packing member according to an embodiment.

FIG. 6 is a perspective view of a second hole packing member according to an embodiment.

Figure 7:
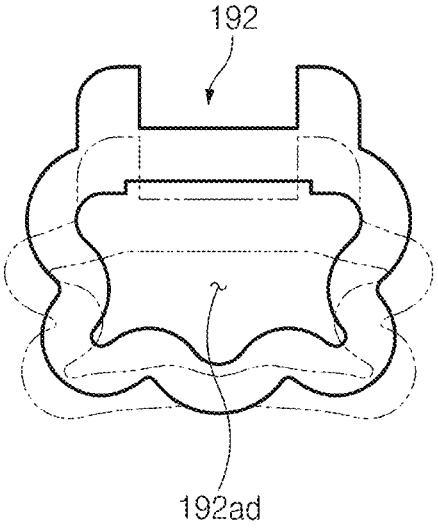
FIG. 7 is a schematic view of the second hole packing member illustrated in FIG. 6.

FIG. 7 is a schematic view of the second hole packing member illustrated in FIG. 6.

As described above, the water heater case 10 may include a display packing member 112*a* extending along a circumference of the display 112 to seal the water heater case 10.

The display packing member 112*a* may be disposed behind the display 112. The display 112 may be supported by the display support frame 113 and mounted on the front cover 111.

The display packing member 112*a* may include a first display packing member 112*b* that extends along the circumference of the display 112 and is disposed between the display 112 and the front cover 111. The display packing member 112*a* may include a second display packing member 112*c* disposed outside the display 112 rather than the first display packing member 112*b* and supported by the display support frame 113.

The second display packing member 112*c* may be provided to be larger than the first display packing member 112*b*. The first display packing member 112*b* and the second display packing member 112*c* may doubly seal the gap between the display 112 and the front cover 111 to improve sealing of the water heater case 10.

Correspondingly, first to fifth hole packing members 191*a*, 192*a*, 193*a*, 194*a*, and 195*a* may also be provided in the first to fifth holes 191, 192, 193, 194, and 195 of the rear cover part 140.

The first hole packing member 191*a* may seal a gap between the first hole 191 and the water heater case 10. The first hole packing member 191*a* may be provided inside the filter 161 (see FIG. 3).

The third hole packing member 193*a* may be provided in the third hole 193 to seal a gap between the second pipe 163 and the water heater case 10. The third hole packing member 193*a* may be provided to surround the second pipe 163.

The third hole packing member 193*a* may extend along a circumferential direction of the second pipe 163. The third hole packing member 193*a* may prevent water discharged from the water heater 20 from being discharged between the second pipe 163 and the water heater case 10.

The third hole packing member 193*a* may include a rear sealing part 193*ac* attached to the rear cover part 140 and a pipe sealing part 193*ab* attached to the second pipe 163. The third hole packing member 193*a* may include a flexible sealing part 193*aa* provided between the rear sealing part 193*ac* and the pipe sealing part 193*ab*.

The flexible sealing part 193*aa* may be a flexible sealing part provided to be flexible so that a surface area increases between the rear sealing part 193*ac* and the pipe sealing part 193*ab*. In other words, the flexible sealing part 193*aa* may be a bellows-type sealing part. The flexible sealing part 193*aa* may increase in surface area even if a direction in which the second pipe 163 is mounted on the rear cover part 140 is inclined, to smoothly seal the gap between the second pipe 163 and the water heater case 10.

However, a shape of the third hole packing member 193*a* is not limited to a circle shape and may be disposed along a circumference of a square shape.

As illustrated in FIG. 6, the second hole packing member 192*a* may be a configuration for discharging the gas discharged from the water heater 20 through the gap between the water heater case 10 and the second hole 192, rather than the pipe.

The second hole packing member 192*a* may be provided to seal a gap between the pipe provided in the second hole 192 and the water heater case 10. The second hole packing member 192*a* may be provided as a square-shaped frame and may be provided to have a pipe inserted therein. The second hole packing member 192*a* may be mounted on the rear cover part 140 through the second hole 192.

The second hole packing member 192*a* may include a lower packing frame 192*aa* and an upper packing frame 192*ac*. The lower packing frame 192*aa* may be provided to be separable from the upper packing frame 192*ac*. The upper packing frame 192*ac* and the lower packing frame 192*aa* may be coupled to each other to define a pipe insertion part 192*ab*. Two corners of the lower packing frame 192*aa* may be portions to be boned to each other.

The pipe insertion part 192*ab* may be defined between the lower packing frame 192*aa* and the upper packing frame 192*ac*. The lower packing frame 192*aa* may define a left side, a right side, and a lower side of the second hole packing member 192*a*. The upper packing frame 192*ac* may define an upper portion of the second hole packing member 192*a*.

A recess may be defined in a surface, which faces left, right, and lower sides of the lower packing frame 192*aa*, and an adhesive member may be provided on the recess surface extending along a circumference of the lower packing frame 192*aa*. A recess may be defined in a surface that faces an upper side of the upper packing frame 192*ac*, and the adhesive member may be provided on the recess surface of the upper packing frame 192*aa*.

The second hole packing member 192*a* may be mounted on the water heater case 10 through the recess defined along the circumference of the second hole packing member 192*a* and may be fixed to the water heater case 10 by the adhesive member provided on the recess surface.

The second hole packing member 192*a* may be made of foamed silicone. The second hole packing member 192*a* may be provided by foaming to hardness of approximately 50.

The lower packing frame 192*aa* and the upper packing frame 192*ac* may define a compressed space 192*ad* therein. The lower packing frame 192*aa* and the upper packing frame 192*ac* may define the compressed space 192*ad* provided inside along a circumference of the pipe and may extend meanderingly along a circumference of the compressed space 192*ad*. That is, the lower packing frame 192*aa* and the upper packing frame 192*ac* may extend in a meandered shape along the circumference of the compressed space 192*ad* in a horizontal cross-section.

According to this structure, even if the second hole packing member 192*a* is pressed by the water heater case 10 or the pipe, a length of the packing may be different due to the meandered shape. Even in this case, the second hole packing member 192*a* may improve the sealing by being compressed or restored.

Figure 8:
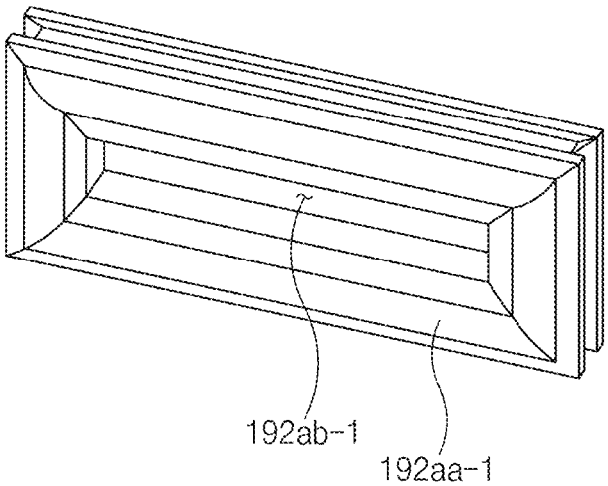
FIG. 8 is a perspective view of a second hole packing member according to another embodiment.

FIG. 8 is a perspective view of a second hole packing member according to another embodiment.

Unlike the second hole packing member 192*a* illustrated in FIG. 7, the second hole packing member 192*a*-1 may be provided in an integrated shape. The second hole packing member 192*a*-1 may include a packing frame 192*aa*-1 and a pipe insertion part 192*ab*-1 defined by the packing frame 192*aa*-1.

A bonding part may be provided at each of the four corners of the second hole packing member 192*a*-1, and the shape and structure of the second hole packing member 192*a*-1 may correspond to the second hole packing member 192*a* in addition to the integrated shape.

Figure 9:
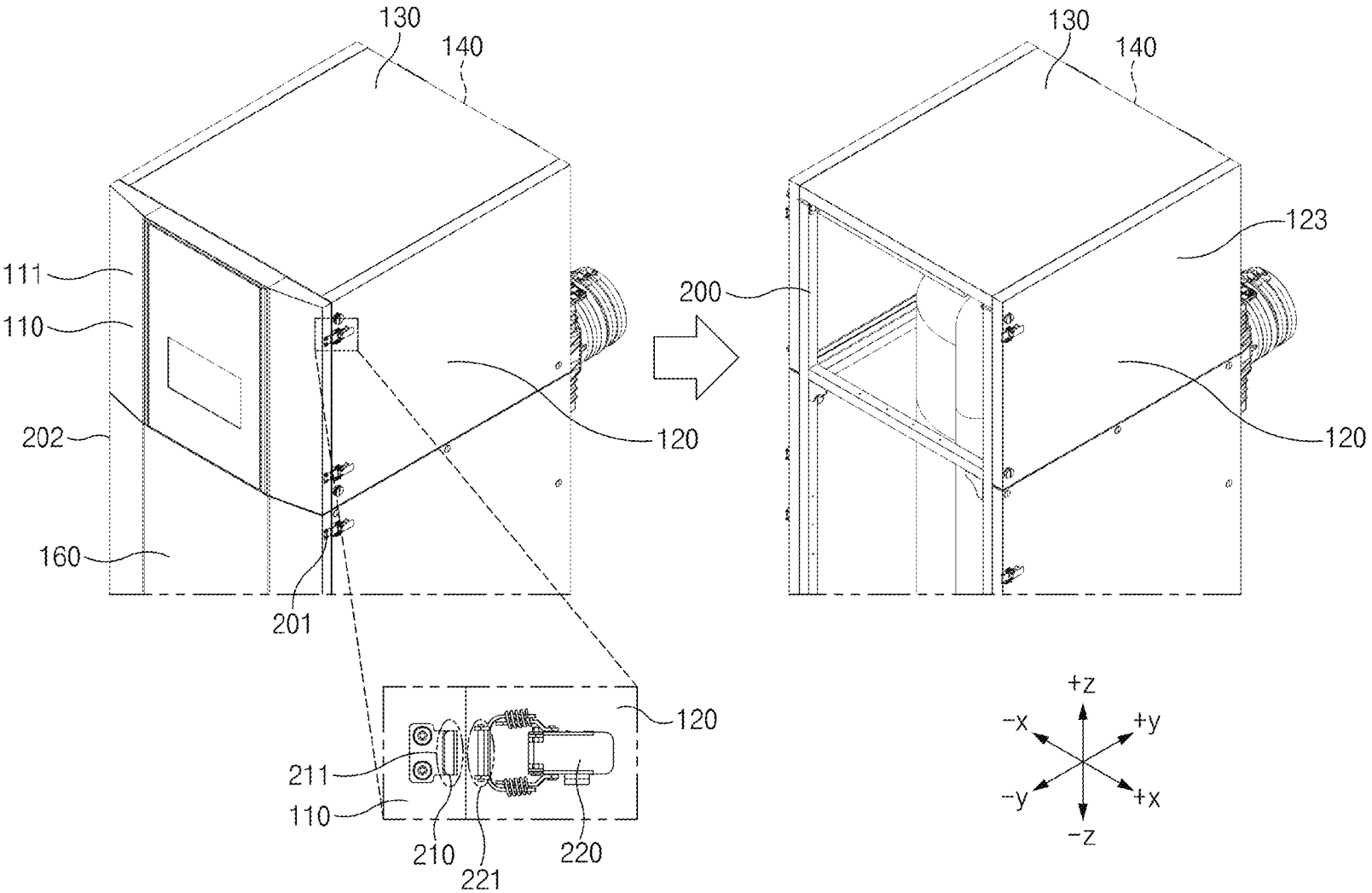
FIG. 9 is a view illustrating a state in which the front cover part of the case for the water heater is coupled to and separated from a side cover part.

FIG. 9 is a view illustrating a state in which the front cover part of the case for the water heater is coupled to and separated from a side cover part.

Figure 10:
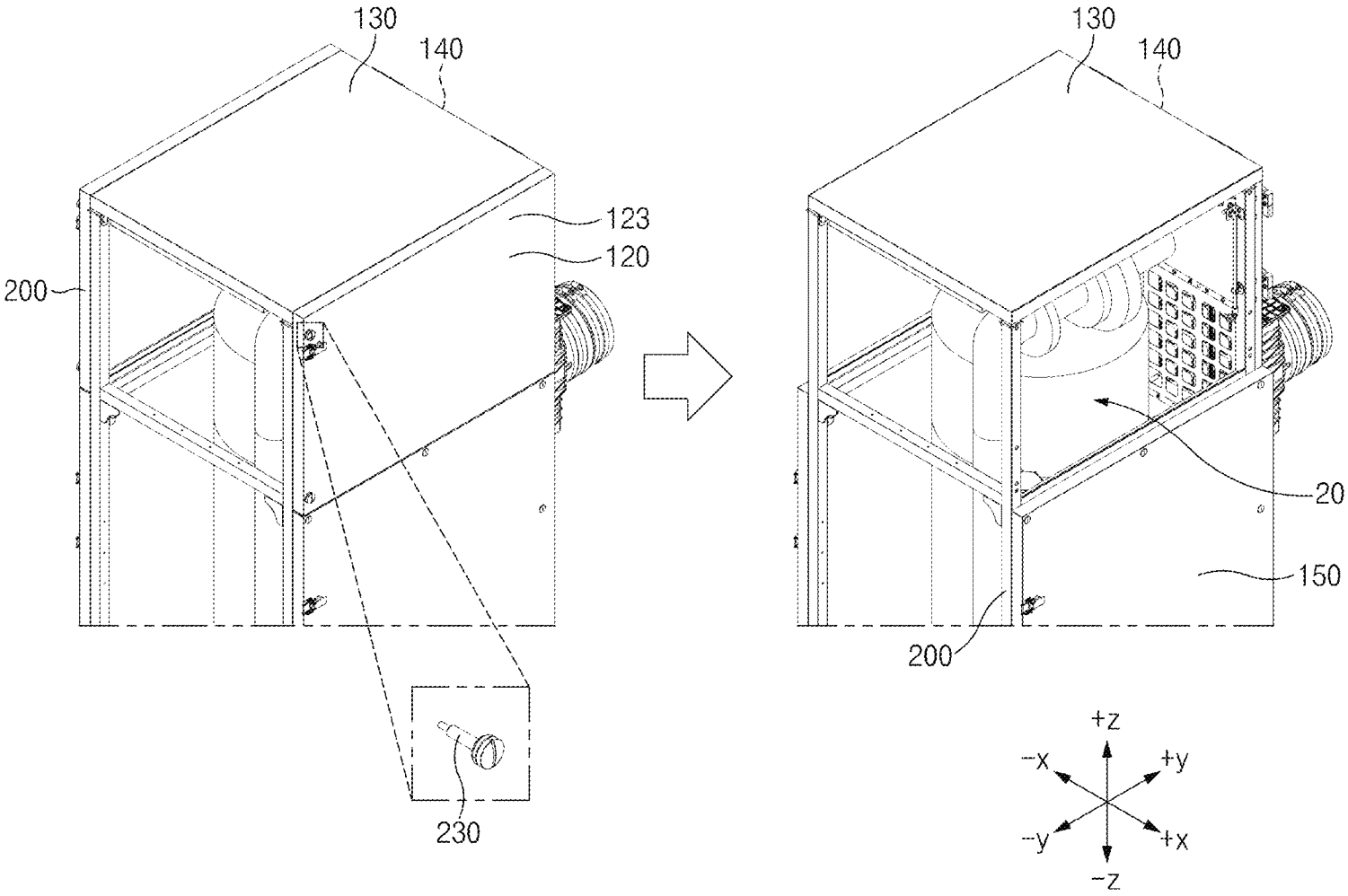
FIG. 10 is a view illustrating a state in which the side cover part of the case for the water heater is coupled to and separated from a case frame.

FIG. 10 is a view illustrating a state in which the side cover part of the case for the water heater is coupled to and separated from a case frame.

Figure 11:
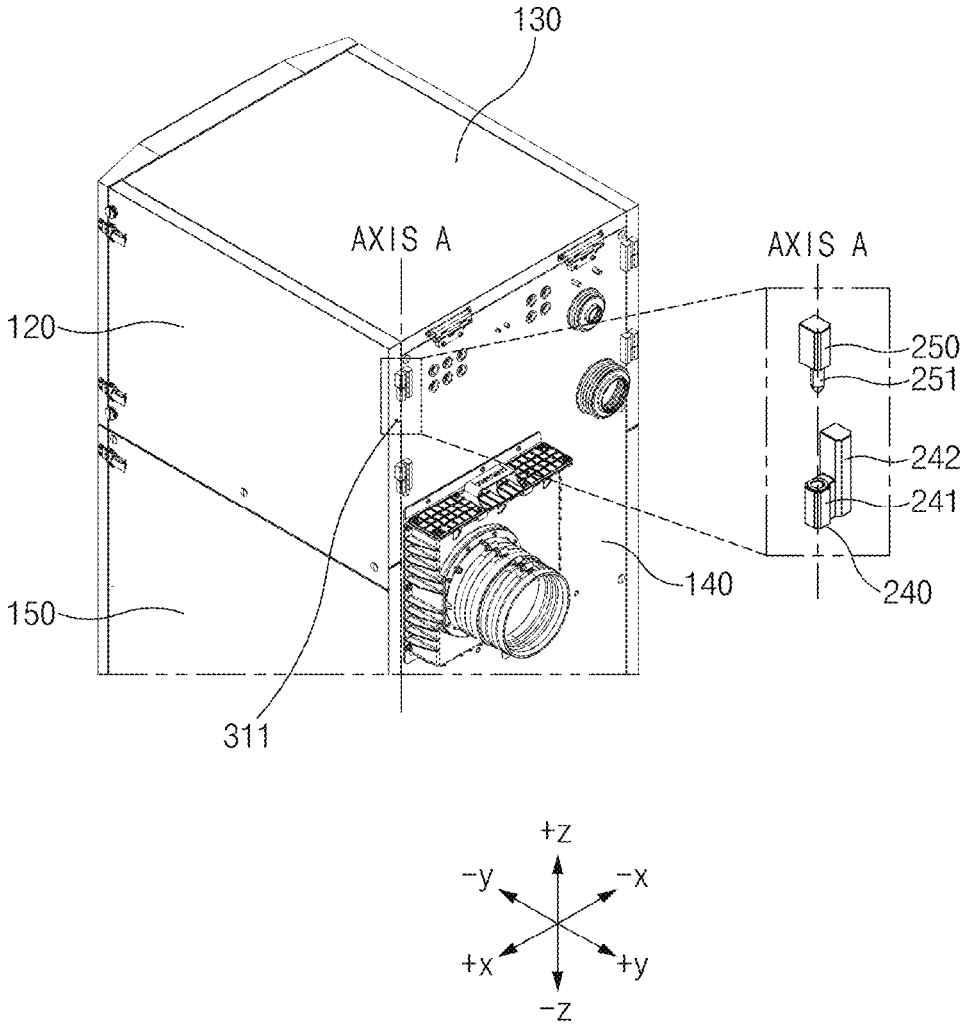
FIG. 11 is a perspective view of the case for the water heater.

FIG. 11 is a perspective view of the case for the water heater.

Figure 12:
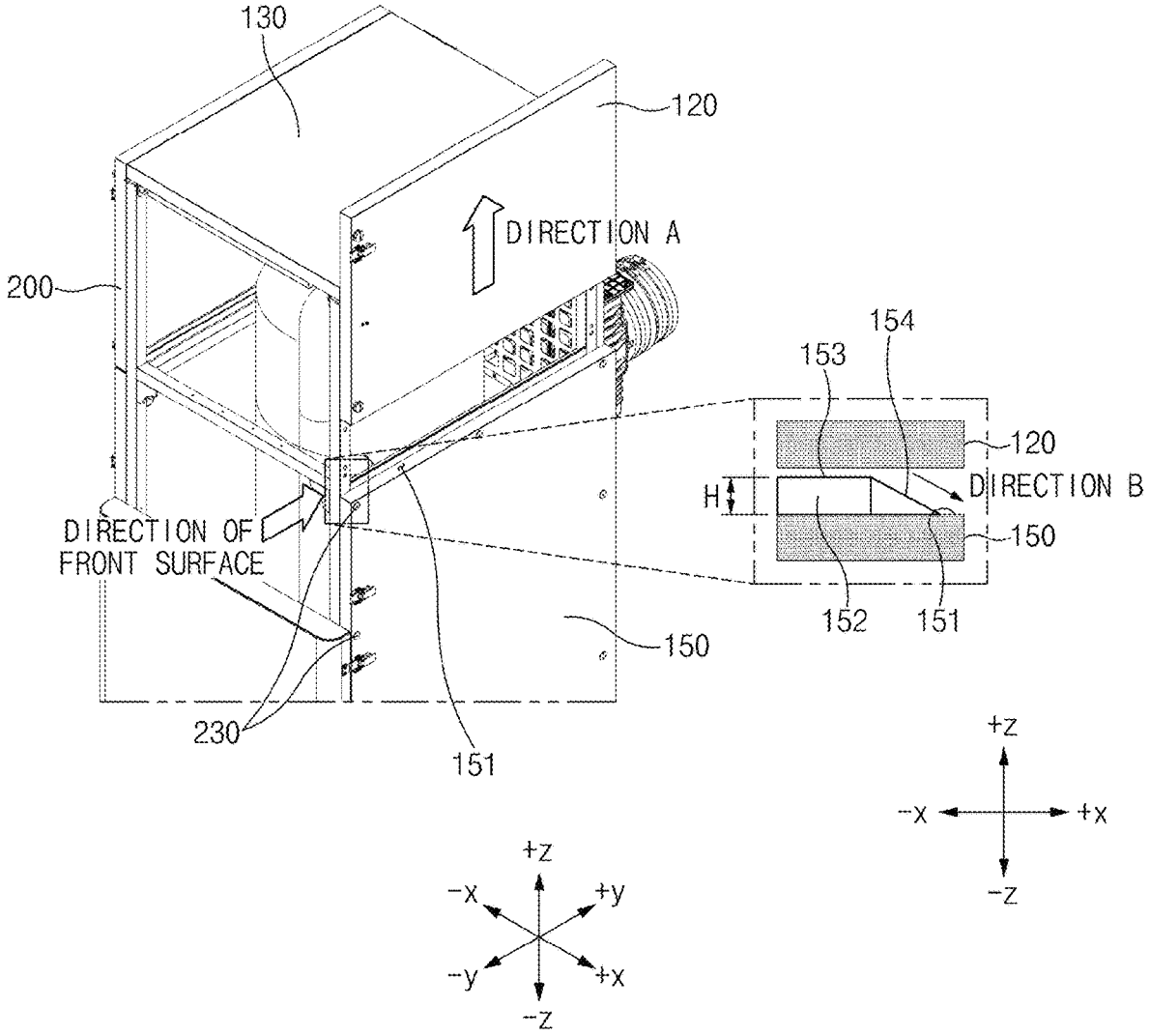
FIG. 12 is a view illustrating a state in which the side cover part of the case for the water heater is separated from the case frame.

FIG. 12 is a view illustrating a state in which the side cover part of the case for the water heater is separated from the case frame.

Figure 13:
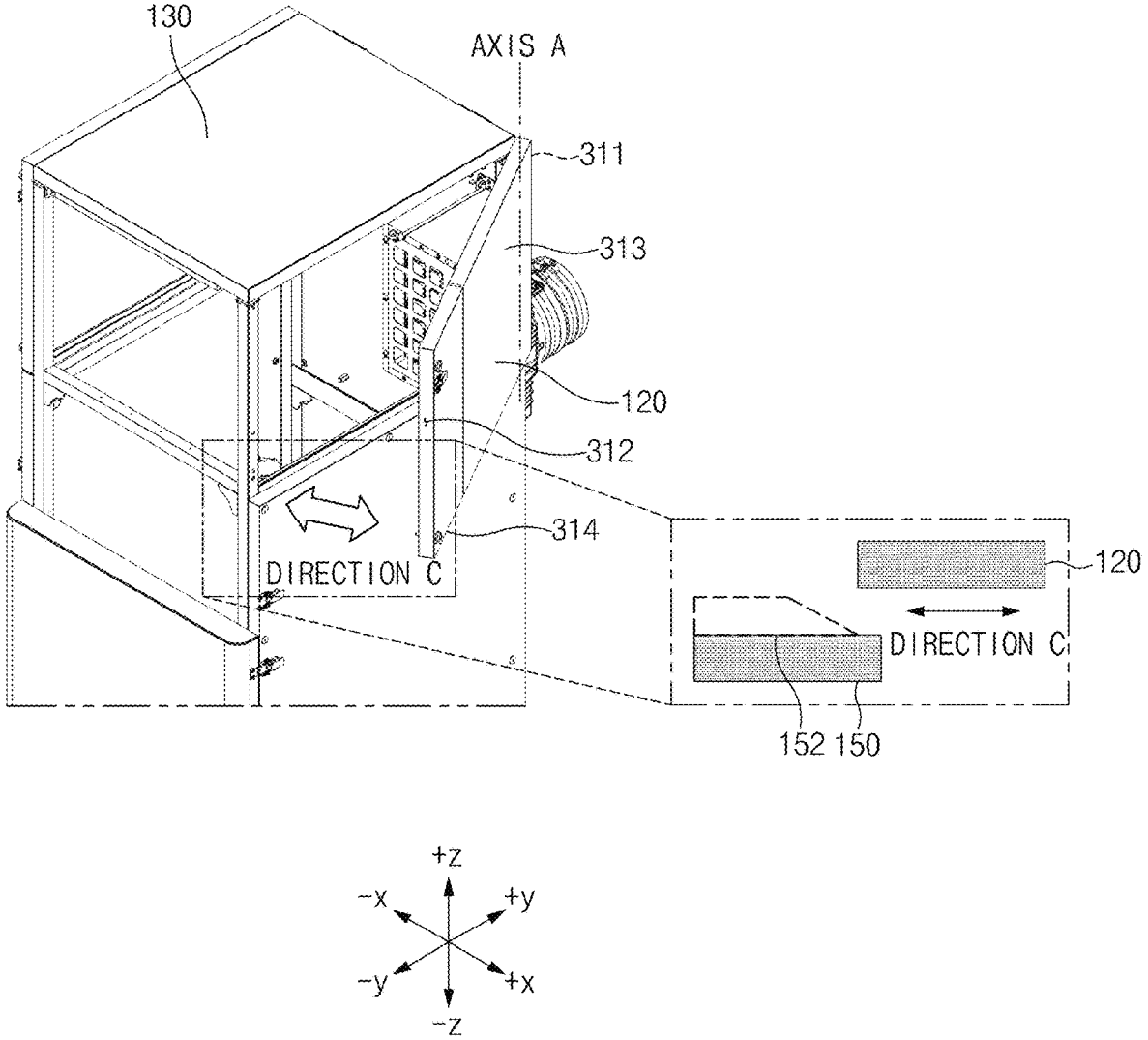
FIG. 13 is a view illustrating a state in which the side cover part of the case for the water heater is opened.

FIG. 13 is a view illustrating a state in which the side cover part of the case for the water heater is opened.

Referring to FIG. 9, the front cover part 110 may include a front cover 111, a hook member 210, and a display 112.

The front cover 111 may be a plate member that covers the front surface of the water heater case 10. The front cover 111 may be made of a metal member, but the type of material of the front cover 111 is not limited thereto.

The hook member 210 may attach and detach the front cover part 110 to/from the side cover part 120.

The hook member 210 may be disposed on an area adjacent to an edge of the front cover part 110.

The front cover part 110 may include a first edge 201 extending along a longitudinal direction (e.g., z-direction) of the water heater case 10, and a second edge 202 extending along the longitudinal direction (e.g., z-direction) of the water heater case 10 and opposite to the first edge 201.

The hook member 210 may be disposed on an area adjacent to the first edge 201 and the second edge 202. For example, the hook member 210 may be provided in plurality along the first edge 201. For example, the hook members 210 may be provided in plurality to be spaced a predetermined distance from each other along the first edge 201.

Although the first edge 201 has been described as an example, it is not limited thereto. For example, the hook member 210 may be provided in plurality along the second edge 202.

The front cover part 110 may be detached from the water heater case 10. The front cover part 110 may be provided to be detachable from the side cover part 120. For example, the front cover part 110 may be mounted on the side cover part 120 by the hook member 210. For example, when the hook member 210 is unlocked, the front cover part 110 may be separated from the side cover part 120.

The hook member 210 may be coupled to a locking member 220 of the side cover part 120, which will be described later. For example, when a locking part 221 of the locking member 220 is hooked by a hook part 211 of the hook member 210, the hook member 210 and the locking member 220 may be coupled to each other.

As the locking part 221 of the locking member 220 is hooked by the hook part 211 of the hook member 210, the front cover part 110 may be mounted on the side cover part 120. When the locking part 221 of the locking member 220 is separated from the hook member 210, the front cover part 110 may be separated from the side cover part 120.

When the front cover part 110 is separated from the side cover part 120, the front cover part 110 may be separated in a direction toward the front surface of the water heater case 10 (e.g., +y direction).

The front cover part 110 may be separated toward the front surface of the water heater case 10, and thus, even when the plurality of water heater cases are disposed adjacent to each other, the maintenance of the water heater may be facilitated.

For example, when the water heater case 10 is disposed in a cascade system, the front cover part may be easily removed without interference from other water heater cases that are adjacent to the side surface. As the front cover is easily removed, the maintenance and installation of the water heater may be facilitated.

The water heater case 10 may further include a front fixing cover part 160.

The front fixing cover part 160 may cover the front surface of the water heater case 10. For example, the front fixing cover part 160 may include a front plate that covers the front surface of the water heater case 10.

The front fixing cover part 160 may be disposed below the front cover part 110. The front fixing cover part 160 may be provided as a cover plate that is separated from the front cover part 110. For example, as the front cover part 110 and the front fixing cover part 160 are provided as separate cover plates, respectively, the front fixing cover part 160 may be detached from the side cover part 120 in separation of the front cover part 110. For example, when the front cover 110 is separated, the front fixed cover 160 may be mounted on the water heater case 10. For example, when the front fixing cover part 160 is separated, the front cover part 110 may be mounted on the water heater case 10.

The front fixing cover part 160 may refer to a portion of the front cover part 110. For example, the front fixing cover part 160 may include a hook member 210.

Referring to FIG. 10, the side cover part 120 may be detached from the case frame 200. For example, the side cover part 120 may be detached from the case frame 200 in a lateral direction (e.g., x-direction), but is not limited to this. For example, the side cover part 120 may be detached from the case frame 200 from the case frame 200 toward an upper portion at which the upper cover part 130 is disposed.

Referring to FIG. 10, the side cover part 120 may include a side cover 123, a locking member 220, an outer fixing member 230, and a hinge shaft member 250.

The side cover 123 may be a cover member that covers the side surface of the water heater case 10. For example, the side cover 123 may include a side plate of the water heater case 10, which is provided to be detachable from the case frame 200.

Referring to FIG. 9, as described above, the side cover part 120 may include the locking member 220. The locking member 220 may be disposed on one area of the side cover part 120 adjacent to the front cover part 110. For example, the locking member 220 may be disposed on one area of the side cover part 120 adjacent to the hook member 210 of the front cover part 110.

As the locking member 220 is hooked by the hook member 210, the front cover part 110 may be coupled to the side cover part 120. When the locking member 220 hooked on the hook member 210 is separated, the front cover part 110 may be separated from the side cover part 120.

Referring to FIG. 10, the side cover part 120 may include an outer fixing member 230.

The outer fixing member 230 may fix the side cover part 120 to the case frame 200. For example, the outer fixing member 230 may pass through the side cover part 120 and the case frame 200. For example, the outer fixing member 230 may pass through a portion of the side cover part 120 and a portion of the case frame 200 from the outside toward the inside. For example, the outer fixing member 230 may pass through a portion of the side cover part 120 adjacent to the front cover part 110. For example, the outer fixing member 230 may pass through a portion of the side cover part 120 adjacent to the first edge 201 of the front cover part 110. For example, the outer fixing member 230 may be disposed on a portion of the side cover part 120, which faces the front surface of the water heater case 10.

The side cover part 120 may be detachably mounted on the case frame 200 by the outer fixing member 230. When the outer fixing member 230 is removed, the side cover part 120 may be separated from the case frame 200. When the outer fixing member 230 is inserted, the side cover part 120 may be mounted on the case frame 200.

Referring to FIG. 11, the side cover part 120 may be connected to the rear cover part 140. For example, a portion of the side cover part 120 may be hinge-coupled to a portion of the rear cover part 140. The side cover part 120 may be hinge-coupled to a portion of the rear cover part 140 on a partial area of the side cover part 120, which faces the rear surface of the water heater case 10. For example, the side cover part 120 may be hinge-coupled to the rear cover part 140 at the rear surface 311 of the side cover part 120.

The side cover part 120 may further include a hinge shaft member 250. For example, the hinge shaft member 250 may be disposed on a partial area of the side cover part 120, which faces the rear surface of the water heater case 10. For example, the hinge shaft member 250 may be disposed on the rear surface 311 of the side cover part 120.

The hinge shaft member 250 may protrude downward. For example, the hinge shaft member 250 may protrude in a direction toward a lower end of the water heater case 10 (e.g., −z direction). For example, the shaft 251 of the hinge shaft member 250 may protrude downward.

The rear cover part 140 may include a shaft accommodation member 240 capable of accommodating the hinge shaft member 250. The shaft accommodation member 240 may be disposed on a partial area of the rear cover part 140 adjacent to the side cover part 120. For example, the hinge shaft accommodation member 240 may be disposed on an edge area of the rear cover part 140, which is in contact with a portion of the rear surface 311.

The hinge shaft member 250 may be coupled to the shaft accommodation member 240. For example, the hinge shaft member 250 may be inserted into the shaft accommodation member 240.

The shaft accommodation member 240 may include a shaft accommodation part 241, in which a groove is defined, and a shaft support part 242 coupled to the shaft accommodation part 241.

A portion of the shaft support part 242 may be coupled to the shaft accommodation part 241, and the other portion may be coupled to the rear cover part 140.

The shaft 251 of the hinge shaft member 250 may be inserted into the groove of the shaft accommodation part 241. As the hinge shaft member 250 is inserted into the shaft accommodation member 240, the side cover part 120 may be hinge-coupled to the rear cover part 140.

As the hinge shaft member 250 is inserted into the shaft accommodation part 241, the side cover part 120 may be attached to the rear cover part 140 about one axis (e.g., axis A) passing through a center of the shaft 251.

The above-mentioned hinge coupling member has been described as an example as including a combination of the hinge shaft member including a shaft and the shaft accommodation member, but is not limited thereto. The hinge coupling member may be provided as a rotatable coupling member other than the shaft.

Referring to FIGS. 11 and 12, the side cover part 120 may be mounted on the rear cover part 140 in a detachable manner in an upward direction.

The side cover part 120 from which the outer fixing member 230 has been removed may be detached upward (e.g., direction A in FIG. 11). For example, when the hinge shaft member 250 moves upward, the hinge shaft member 250 may be separated from the shaft accommodation member 240. As the hinge shaft member 250 is separated from the shaft accommodation member 240, the side cover part 120 may be separated from the rear cover part 140.

Referring to FIG. 12, when the outer fixing member 230 is removed, the front of the side cover part 120 may be separated from the case frame 200. When the hinge shaft member 250 is separated from the shaft accommodation member 240, the side cover part 120 may be separated from the rear cover part 140. For example, the side cover part 120 may be separated from the case frame 200 and the rear cover part 140 in the direction A.

Since the side cover part 120 is separated from the water heater case 10 upward or in the A direction, the maintenance of the water heater may be facilitated even when the plurality of water heater cases are arranged adjacent to each other.

For example, when the water heater case 10 is disposed in a cascade system, as the side cover part 120 is separated upward or in the A direction, a user may easily approach the water heater 20 disposed inside the water heater case 10 without interfering with the other water heater case adjacent thereto. As the user easily approaches the water heater 20, the water heater may be maintained more easily than the water heater accommodated in the case in which only the front surface is opened. In addition, the user may easily install the water heater.

As the water heater is easily maintained and installed, its quality may be improved.

Referring to FIG. 12, the water heater case 10 may further include a side fixing cover part 150. Unlike the side cover part 120, the side fixing cover part 150 may be fixed to the case frame 200. For example, the side fixing cover part 150 may be fixed to the case frame 200 by the outer fixing member 230, but is not limited thereto.

The side fixing cover part 150 may be disposed below the side cover part 120. For example, the side fixing cover part 150 may be disposed on the lower end of the water heater case 10, which is spaced apart from the upper cover part 130.

The side fixing cover part 150 may include a top surface 151 facing the upper side of the water heater case 10. For example, the side fixing cover part 150 may include the top surface 151 facing a first direction (e.g., +z direction).

The top surface 151 of the side fixing cover part 150 may include a protruding area 152.

The protruding area 152 may be disposed on a partial area of the top surface 151 of the water heater case 10. For example, the protruding area 152 disposed on the top surface 151 may be disposed on a front edge area of the top surface 151 adjacent to the front surface of the water heater case 10. For example, the protruding area 152 disposed on the top surface 151 may be disposed on an edge area of the top surface 151 adjacent to the case frame 200 disposed on the front surface of the water heater case 10.

The protruding area 152 may include an area protruding toward the first direction (e.g., +z direction). For example, the protruding area 152 may protrude in a direction toward the side cover part 120.

The protruding area 152 may include a first protruding area 153 having a constant thickness, and a second protruding area 154 of which a thickness is gradually changed.

When viewed in the direction of the front surface of FIG. 12, the first protruding area 153 of the protruding area 152 may have a constant thickness H and extend in the second direction (e.g., +x direction) perpendicular to the first direction (e.g., +z direction). The first protruding area 153 may face a bottom surface of the side cover part 120.

The second protruding area 154 may be inclined downward in a direction that is away from the first protruding area 153, and its thickness may be gradually changed. For example, the thickness of the second protruding area 154 may gradually decrease as it moves away from the first protruding area 153. For example, the thickness of the second protruding area 154 may gradually decrease along a direction B of FIG. 11.

One area of the side cover part 120 may droop downward due to a self-weight of the side cover part 120. For example, if the outer fixing member 230 is removed, an area opposite the side cover part 120, which is not an area hinge-coupled to the rear cover part 140.

For example, the second area 314 of the front 312 of the side cover 120 may droop relatively more than a portion of the rear 311 that is hinge-coupled due to its own weight.

When the drooping occurs in the second area 314, the side cover part 120 may be supported by the protruding area 152. The side cover part 120 may be supported to improve the quality of the water heater case 10.

As the side cover part 120 is supported, external force applied to a hinge coupled to the rear cover part 140 may be reduced when compared to a case in which the side cover part is not supported. As the external force applied to the hinge is reduced, the quality and lifespan of the case 10 for the water heater may increase.

FIG. 13 illustrates a state in which the side cover part 120 of FIG. 12 rotates around one axis. The side cover part 120 hinge-coupled to the rear cover part 140 may rotate around the one axis (axis A in FIG. 11) of the hinge shaft member 250. For example, the hinge-coupled side cover part 120 may rotate in a direction C, and thus, the side surface of the water heater case 10 may be opened and closed.

Since the inclined second protruding area 154 is defined on the protruding area 152, the drooping side cover part 120 may be smoothly opened and closed in the direction C along the inclined surface.

The first area 313 and the second area 314 illustrated in FIG. 13 are merely examples shown for convenience of explanation, and the scope of the areas is not limited thereto.

The side fixing cover part 150 disposed at the left side is illustrated as an example of the side fixing cover part 150 illustrated in FIGS. 9 to 13, but is not limited thereto. The side fixing cover part disposed at the right side may also refer to the side fixing cover part 150 illustrated in FIGS. 9 to 13.

Figure 14:
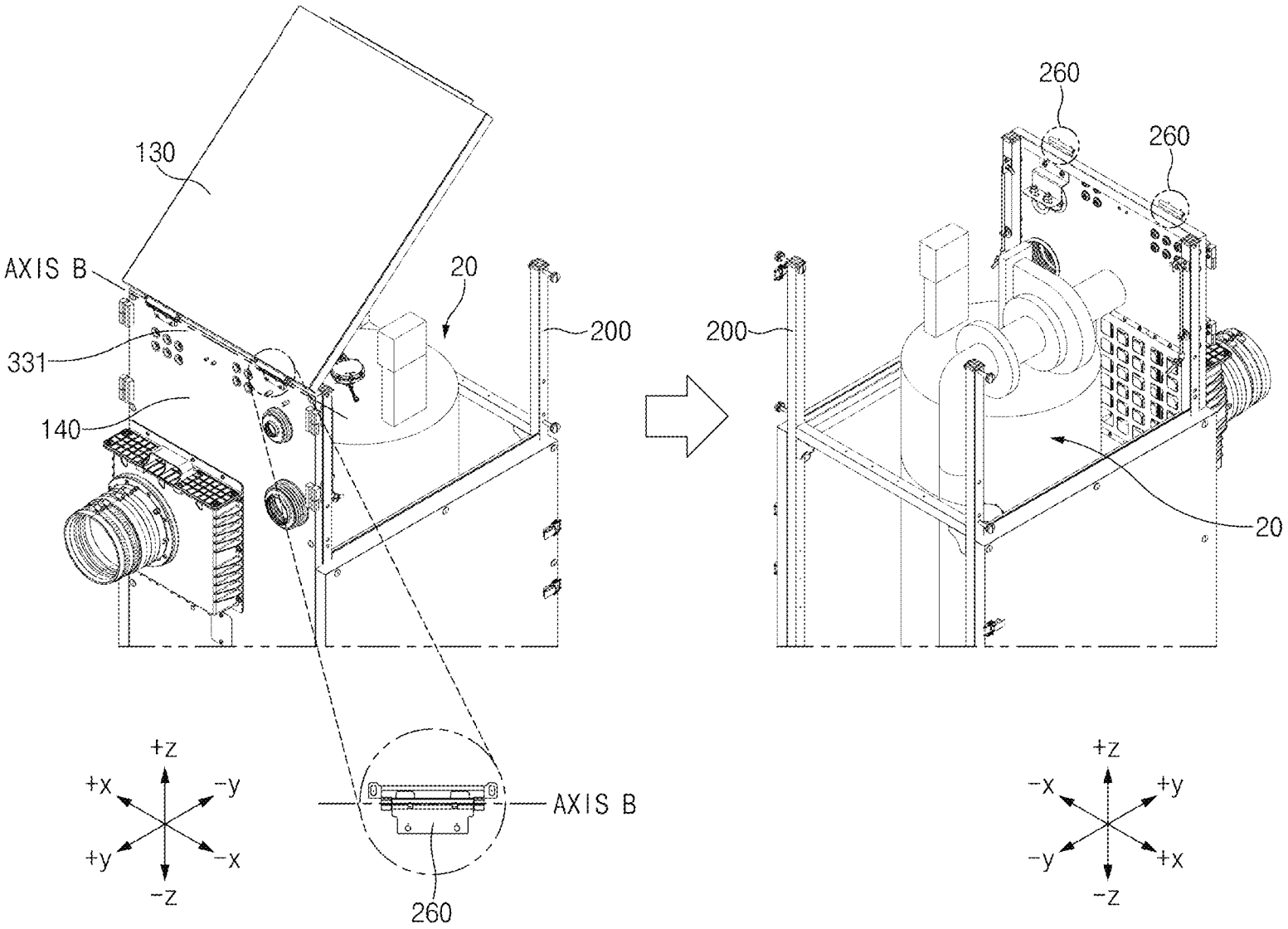
FIG. 14 is a view illustrating a state in which an upper cover part of the case for the water heater is opened.

FIG. 14 is a view illustrating a state in which the upper cover part of the case for the water heater is opened.

Figure 15:
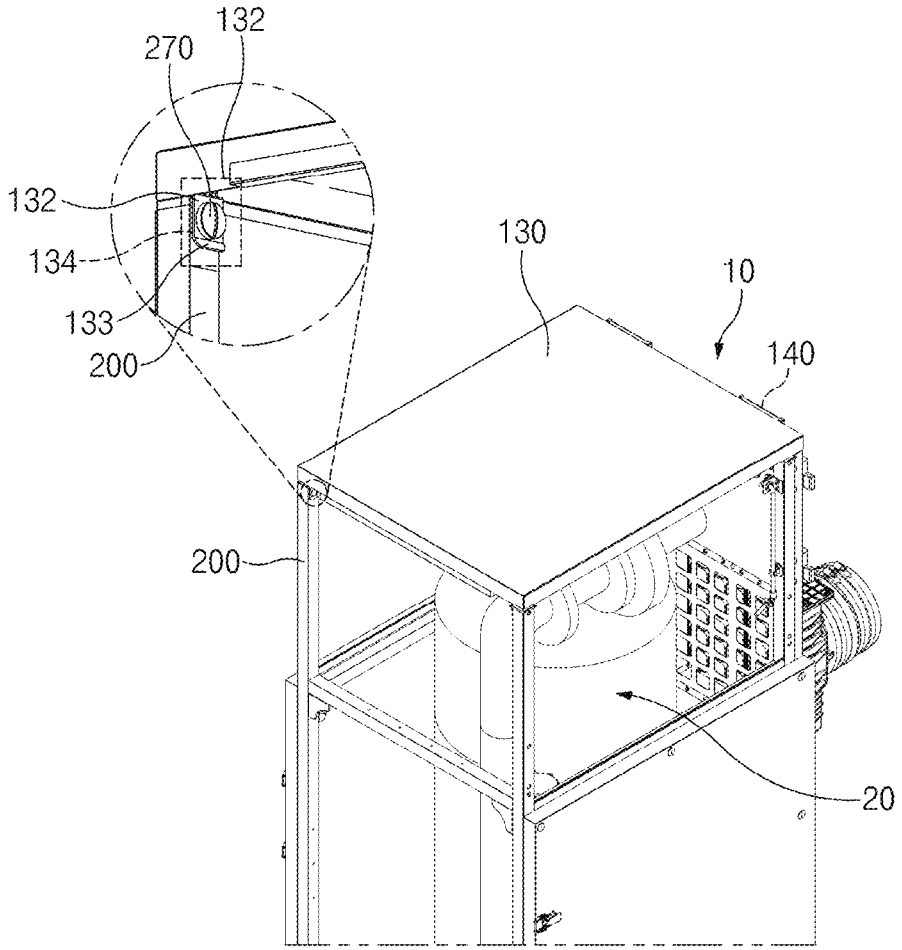
FIG. 15 is a view illustrating a state in which the upper cover part of the case for the water heater is coupled to the case frame.

FIG. 15 is a view illustrating a state in which the upper cover part of the case for the water heater is coupled to the case frame.

Figure 16:
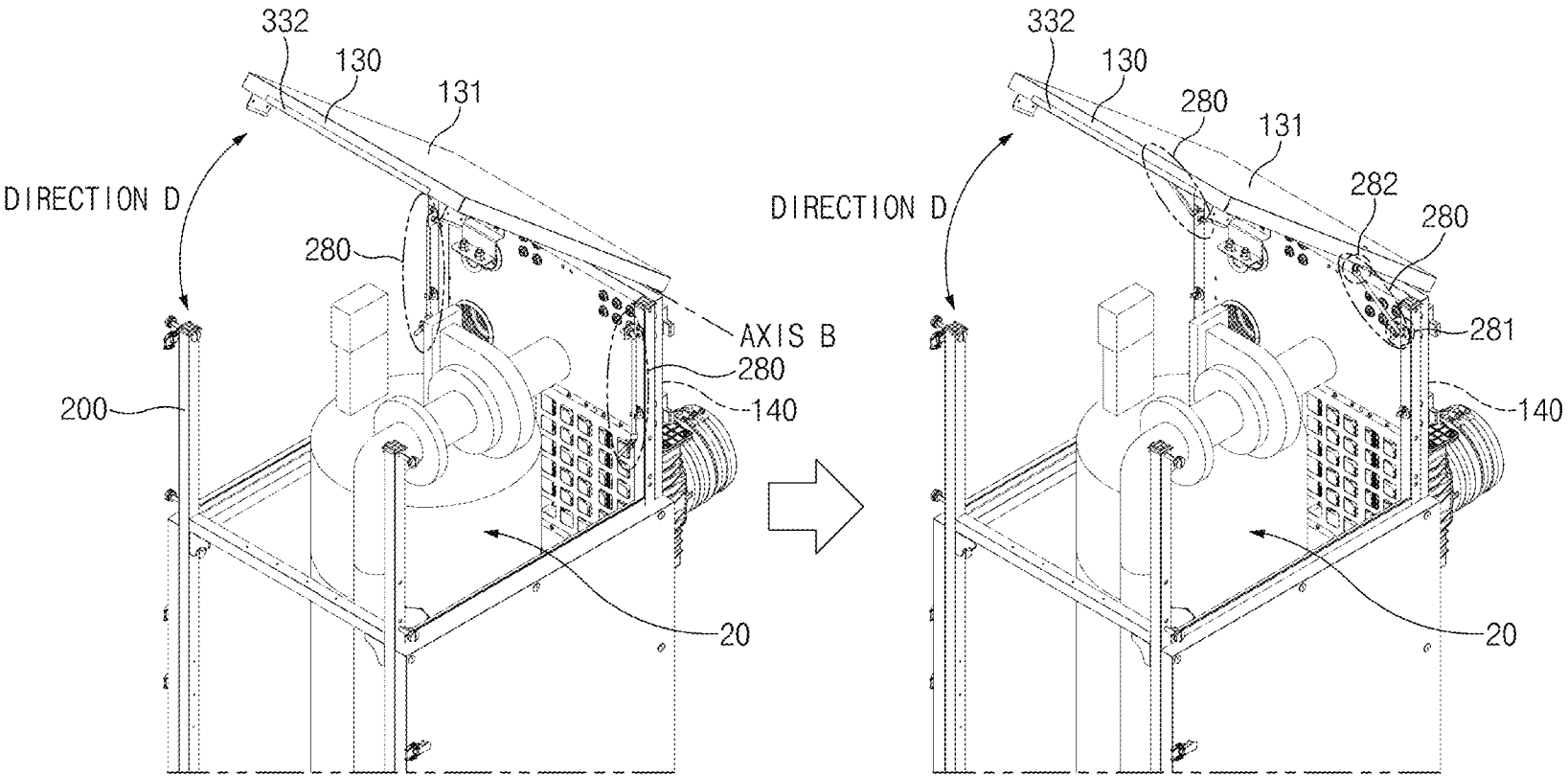
FIG. 16 is a view illustrating a state in which the side cover part of the case for the water heater is opened.

FIG. 16 is a view illustrating a state in which the side cover part of the case for the water heater is opened.

The water heater case 10 may include an upper cover part 130.

The upper cover part 130 may be provided to be opened and closed in the water heater case 10. For example, the upper cover part 130 may be provided to be opened and closed from the case frame 200.

The upper cover part 130 may be provided to be detachable from the rear cover part 140.

The upper cover part 130 may be coupled to the rear cover part 140. For example, the upper cover part 130 may be hinge-coupled to the rear cover part 140. For example, the upper cover 130 may be coupled to the rear cover 140 by a hinge member 260 at the rear surface 331 of the upper cover 130.

The upper cover part 130 hinge-coupled to the rear cover part 140 may rotate around one axis of the hinge member 260. For example, the upper cover part 130 may rotate about an axis (e.g., axis B in FIG. 14) that passes through a portion of the hinge member 260.

The upper cover part 130 may be provided to be detachable from the case frame 200.

The upper cover part 130 may include an upper cover 131, a protrusion 132, and an inner fixing member 270.

The upper cover 131 may include a cover member facing the upper side of the water heater case 10. For example, the top cover 131 may include an upper plate of the water heater case 10.

The protrusion 132 may protrude from a portion of the upper cover 131. The protrusion 132 may protrude downward from a portion of the upper cover 131.

When the upper cover 131 covers the upper portion of the water heater case 10, the protrusion 132 extending from a portion of the upper cover 131 may be in contact with the case frame 200. For example, the outer surface 133 of the protrusion 132 may be exposed to the outside, and the inner surface 134 of the protrusion 132 may face the case frame 200.

The protrusion 132 may include a hole. The inner fixing member 270, which will be described later, may pass through the hole of the protrusion 132.

The inner fixing member 270 may fix the upper cover part 130 to the case frame 200. For example, the inner fixing member 270 may pass through the hole of the protrusion 132 and a portion of the case frame 200 inside the water heater case 10.

As the inner fixing member 270 passes through the hole of the protrusion 132 and the portion of the case frame 200, the upper cover part 130 may be fixed to the case frame 200. When the inner fixing member 270 is removed, the side cover part 120 may be separated from the case frame 200.

Referring to FIG. 16, the case frame 200 may further include a support member 280.

The support member 280 may be coupled to a portion of the case frame 200. For example, the support member 280 may be coupled to an inner surface of the case frame 200 adjacent to the rear cover part 140. For example, the support member 280 may be fixed to the inner surface of the case frame 200 along a longitudinal direction (e.g., z-direction) of the case frame 200.

The support member 280 may support the opened upper cover part 130 with respect to the case frame 200.

The upper cover part 130 may be opened and closed around one axis of the hinge member 260. For example, when the inner fixing member 270 is removed, the upper cover part 130 may be opened and closed in a direction D around the axis B in FIG. 16. For example, as the upper cover part 130 is opened and closed in the direction D, the upper cover part 130 may be opened with respect to the case frame 200.

When the upper cover part 130 is opened, the support member 280 may support the upper cover part 130 with respect to the case frame 200.

One end of the support member 280 may be connected to a portion of the case frame 200.

The other end of the support member 280 may be connected to a portion of the upper cover part 130. For example, the other end of the support member 280 may be connected to the bottom surface 332 of the upper cover 131 of the upper cover part 130. One end of the support member 280 may be fixed to the case frame 200, and the other end may be fixed to the bottom surface 332 of the upper cover 131.

As the support member 280 is fixed to the upper cover 131 and the case frame 200, the upper cover part 130 may be maintained in the opened state.

As the upper cover part 130 are opened and closed in the upper or direction D of the water heater case 10, the maintenance of the water heater may be facilitated even when the plurality of water heater cases are disposed adjacent to each other.

For example, when the water heater case 10 is disposed in a cascade system, as the upper cover part 130 is opened and closed in the upward or direction D, the user may easily approach the water heater 20 disposed inside the water heater case 10 without interfering with the other water heater case adjacent thereto.

As the user easily approaches the water heater 20 without the interference, the water heater 20 disposed inside the water heater case 10 may be maintained more easily than the water heater accommodated in the case that can only be opened at the front surface. In addition, the user may easily install the water heater. As the water heater is easily maintained and installed, its quality may be improved.

The combination of the above-described hook member 210 and locking member 220 may be provided as a fastener, but is not limited thereto. For example, the combination of the hook member 210 and the locking member 220 may be provided as a hook-shaped hook member and a locking member.

Each of the outer fixing member 230 and the inner fixing member 270 described above may include a knob-shaped screw, but is not limited thereto. For example, each of the outer fixing member 230 and the inner fixing member 270 may include a knob-shaped nail. For example, each of the outer fixing member 230 and the inner fixing member 270 may include a protruding insertion member.

According to the present invention, the case for the water heater that is easily maintained and installed may be provided to improve the quality of the water heater.

The above-disclosed subject matter is to be considered illustrative, and not restrictive, and the appended claims are intended to cover such modifications, enhancements, and other embodiments, which fall within the true spirit and scope of the present invention. Thus, the embodiment of the present invention is to be considered illustrative, and not restrictive, and the technical spirit of the present invention is not limited to the foregoing embodiment. Therefore, the scope of the present invention is defined not by the detailed description of the invention but by the appended claims, and all differences within the scope will be construed as being comprised in the present invention.

What is claimed is:

1. A case for a water heater, comprising:

a case cover provided to accommodate the water heater in an inner space thereof; and a case frame configured to support the case cover in the inner space, wherein the case cover comprises:

a rear cover part including a plurality of holes through which a plurality of pipes connected to the water heater pass;

an upper cover part configured to cover an upper portion of the water heater and provided to be detached from the case frame;

a side cover part configured to cover a side surface of the water heater and provided to be detached from the case frame; and a front cover part configured to cover a front surface of the water heater and provided to be detached from the side cover part, wherein the side cover part is mounted on the case frame by an outer fixing member that passes through a portion of the side cover part and a portion of the case frame from the outside.

2. The case of claim 1, wherein the front cover part includes a hook member, the side cover part includes a locking member coupled to the hook member, and the locking member is hooked on the hook member so that the front cover part is mounted on the side cover part.

3. The case of claim 1, wherein the upper cover part is mounted on the case frame by an inner fixing member that passes through a portion of the upper cover part and a portion of the case frame from the inside.

4. A case for a water heater, comprising:

a case cover provided to accommodate the water heater in an inner space thereof; and a case frame configured to support the case cover in the inner space, wherein the case cover comprises:

a rear cover part including a plurality of holes through which a plurality of pipes connected to the water heater pass;

an upper cover part configured to cover an upper portion of the water heater and provided to be detached from the case frame;

a side cover part configured to cover a side surface of the water heater and provided to be detached from the case frame; and a front cover part configured to cover a front surface of the water heater and provided to be detached from the side cover part, wherein the case frame further comprises a support member, wherein, as one end of the support member is fixed to a portion of the case frame, and the other end of the support member is fixed to a portion of the upper cover part, the support member is configured to support the upper cover part so as to be maintained in an opened state with respect to the case frame.

5. The case of claim 1, wherein a portion of the side cover part is hinge-coupled to a portion of the rear cover part.

6. The case of claim 5, wherein the side cover part further includes a hinge shaft member that protrudes downward, the rear cover part includes a shaft accommodation member configured to accommodate the hinge shaft member, a shaft of the hinge shaft member protrudes downward, and as the shaft is inserted into an accommodation part of the shaft accommodation member, the side cover part is hinge-coupled to the rear cover part.

7. The case of claim 1, wherein the side cover part is mounted on the case frame so as to be separable upward from the case frame.

8. The case of claim 1, wherein the case cover further comprises a side fixing cover part disposed below the side cover part and fixed to the case frame, and a protruding area protruding upward is defined on a top surface of the side fixing cover part.

9. The case of claim 8, wherein the protruding area includes:

a first protruding area having a predetermined thickness and extending in a direction of a side surface perpendicular to an upward direction; and a second protruding area inclined downward with respect to a direction that is away from the first protruding area and having a thickness that is gradually changed.

10. The case of claim 1, further comprising a packing member coupled to the case frame and in contact with the case frame and the case cover to maintain sealing of the inner space.

11. A case for a water heater, comprising:

a case cover provided to accommodate the water heater in an inner space thereof; and a case frame configured to support the case cover in the inner space, wherein the case cover comprises:

a rear cover part including a plurality of holes through which a plurality of pipes connected to the water heater pass;

an upper cover part configured to cover an upper portion of the water heater and provided to be detached from the case frame;

a side cover part configured to cover a side surface of the water heater and provided to be detached from the case frame; and a front cover part configured to cover a front surface of the water heater and provided to be detached from the side cover part, wherein the case further comprises a packing member coupled to the case frame and in contact with the case frame and the case cover to maintain sealing of the inner space, wherein the packing member comprises:

a front packing member disposed between the front cover part and the case frame to extend along a circumference of the front cover part; and a side packing member disposed between the side cover part and the case frame to extend along a circumference of the side cover part.

12. The case of claim 11, wherein an upper end of each of the front packing member and the side packing member is disposed between the upper cover part and the side cover part or between the upper cover part and the front cover part to extend along a circumference of the upper cover part.

13. The case of claim 1, further comprising:

a display mounted on the front cover part; and a display packing member extending along a circumference of the display to seal a gap between the display and the front cover part.

14. The case of claim 1, further comprising a hole packing member provided in each of the plurality of holes to seal a gap between the pipe and the rear cover part.

15. The case of claim 14, wherein the hole packing member comprises:

a pipe sealing part attached to the pipe;

a rear sealing part attached to the rear cover part; and a flexible sealing part provided between the pipe sealing part and the rear sealing part.

16. The case of claim 14, wherein the hole packing member is mounted on the rear cover part through a hole of the rear cover part and is configured to define a compression space provided therein along a circumference of the pipe, wherein the hole packing member extending in a meandered shape along a circumference of the compression space.

17. The case of claim 1, wherein the upper cover part is provided to be hinge-coupled to the rear cover part, and the upper cover part is provided to be rotatable with respect to the rear cover part around a hinge member.

* * * * *